United States Patent [19]

Fujiwara

[11] Patent Number: 4,601,241

[45] Date of Patent: Jul. 22, 1986

[54] DOT LINE PRINTER

[75] Inventor: Shinsuke Fujiwara, Osaka, Japan

[73] Assignee: NEC Home Electronics, Ltd., Osaka, Japan

[21] Appl. No.: 695,348

[22] Filed: Jan. 28, 1985

[30] Foreign Application Priority Data

Jan. 31, 1984 [JP] Japan ..... 59-15783

[51] Int. Cl.[4] ..... B41J 3/00

[52] U.S. Cl. ..... 101/93.04; 101/93.09; 400/121; 400/322

[58] Field of Search ..... 101/93.04, 93.05, 93.09; 400/121, 124, 320, 322

[56] References Cited

U.S. PATENT DOCUMENTS 3,789,969 2/1974 Howard ..... 400/124
4,053,040 10/1977 McGourty ..... 400/320 X
4,151,447 4/1979 von der Heide ..... 400/320 X
4,428,693 1/1984 Bovio ..... 400/320 X

*Primary Examiner*—Paul T. Sewell
*Attorney, Agent, or Firm*—Cushman, Darby & Cushman

[57] ABSTRACT

A dot line printer in which, as its head carriage is driven, a plurality of printing heads arranged on the head carriage at equal intervals are moved in a direction perpendicular to the sheet feeding direction, to print on a printing sheet set on the platen. The dot line printer has a linear scale secured to the head carriage, and a linear sensor provided on a head carriage supporting frame, and a sensor for detecting the displacement of the linear scale to produce a detection signal which is processed to obtain the present position of the head carriage and the correct printing timing of the printing heads.

4 Claims, 6 Drawing Figures

DOT LINE PRINTER

BACKGROUND OF THE INVENTION

The present invention relates to a dot line printer employed as an output device in a personal computer or the like.

As the head carriage is driven in a dot line printer, a plurality of printing heads arranged on the head carriage at equal intervals are moved with a predetermined stroke in a direction perpendicular to the sheet feeding direction to print on a printing sheet set on the platen. In order to allow the printing heads to print in the desired place on the printing sheet, it is essential to detect the printing time for the printing heads with high accuracy.

A conventional dot line printer having a head carriage driving mechanism and a printing timing detecting mechanism is shown in FIG. 1.

In FIG. 1, reference numeral 1 designates a head carriage. The head carriage 1 has a plurality of printing heads 2 arranged at equal intervals. The printing heads 2 confront a printing sheet A on a platen 3. The arrow 100 on printing sheet A indicates the direction of movement of printing sheet A relative to printing heads 2. A head carriage driving motor 5 is provided at a predetermined position on a frame 4. A worm gear 6 is mounted on the shaft 5*a* of the motor 5. The worm gear 6 is engaged with a worm wheel 7 provided on the frame 4. The worm wheel 7 is engaged with a gear 8 which is supported on the frame 4. A rotary encoder 9 is mounted on the shaft 8*a* which supports the gear 8. The rotary encoder 9 is made up a rotary disk 9*a*, coaxial with the gear 8, and has elongated slits 9*b* radially arrange about the circumference of disk 9*a*, and a photo sensor 9*c*. Photo sensor 9*c* is positioned relative to rotary disk 9*a* to detect slits 9*b* in rotary disk 9*a* as rotary disk 9*a* rotates. A cam 10 for moving the head carriage 1 linearly and laterally for reciprocal movement is provided on the rotary encoder 9. The cam 10 and corresponding cam post 10*b* define a track therebetween designated as cam groove 10*a*. Cam follower 11 has one end slidably engaged in cam groove 10*a*. The other end of cam follower 11 is secured to carriage 1.

When the motor 5 is driven in a direction indicated by arrow 101, the rotation of the motor 5 is transmitted through the worm gear 6, the worm wheel 7, which rotates as shown by arrow 102, and the gear 8 to the cam 10, which rotates as shown by arrow 103, to thereby drive cam follower 11 and head carriage 1. As a result, the head carriage 1 is moved linearly and laterally at a uniform speed in a direction perpendicular to the sheet feeding direction as indicated by arrow 100. In this operation, the printing timing of the printing heads 2 is detected as photo sensor 9*c* counts the slits 9*b* in the rotating rotary disk 9*a*, thereby detecting the number of revolutions of rotational angle of the rotary disk 9*a*.

In dot line printers of this type it is essential to detect the printing timing accurately. In the above-described conventional dot line printer, it is essential to form the slits 9*b* in the rotary disk 9*a* with high precision to insure accurate printing timing. However, the manufacturing cost, particularly for the precision manufacture of disk 9*a*, is high, and the detecting mechanism is expensive. The device also is disadvantageous in that, if the cam 10 is deformed, the rotary encoder 9 must be replaced in its entirety. In addition, since the cam follower 11 is slidably tracked within cam groove 10*a*, the cam 10, cam post 10*b* and/or the cam follower 11 rapidly become worn during use thereby altering the stroke of the head carriage out of alignment. As a result, it becomes impossible to detect the printing timing accurately, and to print in place.

SUMMARY OF THE PRESENT INVENTION

According to the present invention, however, a dot line printer is provided with a reciprocally driven printing mechanism carrying a plurality of printing heads arranged in spaced apart relationship at equal intervals thereon in confronting relationship to a cylindrical platen which printing heads are moved with a predetermined stroke in a direction perpendicular to the sheet feeding direction to print on a sheet rolled over the platen and in which the printing timing of the printing heads is accurately determined irrespective of the head carriage driving mechanism. The invention is of simple construction and low in manufacturing cost.

The dot line printer of the present invention is particularly well suited for use as an output printer for a personal home computer. The dot line printer of the present invention generally includes a printer frame, a head carriage having a plurality of printing heads spaced apart thereon at equal intervals, a mechanism for mounting the head carriage for reciprocal movement perpendicular to the printing sheet movement such that the printing heads face, i.e., confront, the printing sheet and a detector for detecting the position of the head carriage at any given time and controlling the printing timing of the printing heads. More particularly, the detecting element includes a linear scale mounted on the head carriage. A linear sensor is provided on a frame which supports the head carriage or near the frame in such a manner that the linear sensor confronts the linear scale with a predetermined clearance therebetween, the linear sensor being adapted to detect an amount of displacement of the linear scale, and to thus detect printing timing for the printing heads.

The nature, principle and utility of the invention will become more apparent from the following detailed description when read in conjunction with the accompanying drawings.

DETAILED DESCRIPTION OF THE INVENTION

Figure 1:
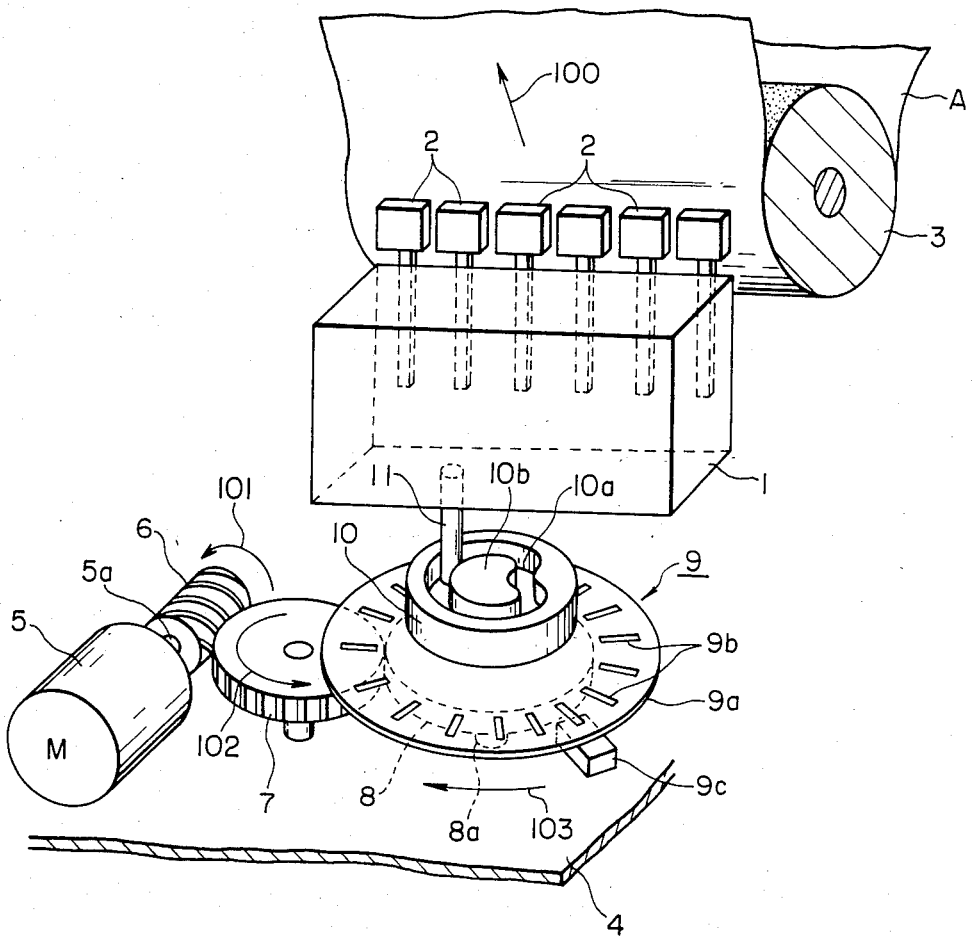
FIG. 1 PRIOR ART
FIG. 1 (prior art) is a perspective view showing a head carriage driving mechanism and a printing timing detecting mechanism in a conventional dot line printer.
Figure 2:
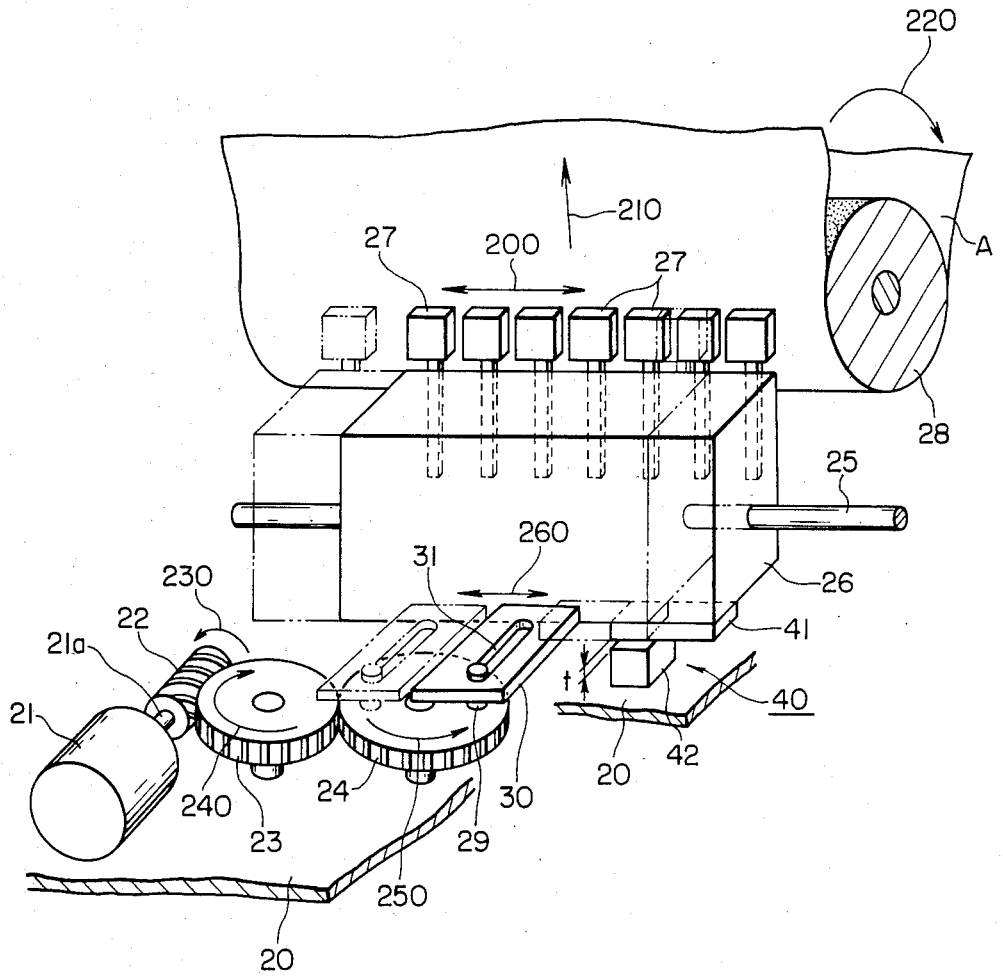
FIG. 2 is a perspective view showing one example of a dot line printer according to the invention.

An exemplary embodiment of a dot line printer according to the present invention is as shown in FIG. 2. A head carriage driving motor 21 similar to one shown in FIG. 1 is provided on a base frame 20. A worm gear 22 is mounted on the output shaft 21*a* of the motor 21. The worm gear 22 is engaged with a work wheel 23 provided on the frame 20. The work wheel 23 is engaged with a gear 24 which is supported for rotatable movement on frame 20. A head carriage 26 is slidably mounted for reciprocal movement on a guide shaft 25 supported by or in supported relationship to the frame in such a manner that the head carriage 26 is movable for a predetermined distance back and forth in a direction perpendicular to the sheet feeding direction as indicated by arrow 200 on sheet A. The head carriage 26 has a plurality of printing heads 27 arranged at equal intervals. The printing heads 27 confront a printing sheet A on a cylindrical platen 28. Printing heads 27 and printing sheet A are spaced apart by a predetermined distance.

A cam mounted on the frame 20 is provided for camming cam plate 30. A cam shaft 29 is embedded in the gear 24 at a predetermined distance from the center of the gear 24. A cam plate 30 having an elongated cam groove 31 therein is extended from a head carriage 26 in such a manner that the cam shaft 29 is slidably engaged with the cam groove 31. Cam groove 31 is especially configured to receive cam shaft 29.

Detector 40 for detecting the position of the head carriage 26 and for detecting and controlling the printing timing of the printing heads 27 is positioned between head carriage 26 and frame 20. The detector 40 includes a linear scale 41 provided on the bottom of the head carriage 26, and a linear sensor 42 in operative relationship to linear scale 41 is positioned on the base frame 20.

Figure 3:
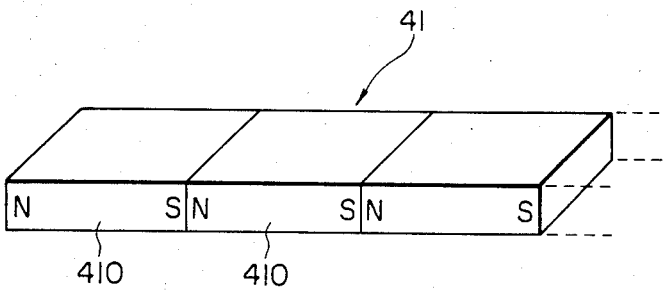
FIG. 3 is a perspective view showing a linear scale in the dot line printer in FIG. 2.

The linear scale 41, as shown in FIG. 3 includes a series of magnet pieces 410 which are arranged side by side in such a manner that the N pole of one magnet piece is followed by the S pole of the next magnet.

Figure 4:
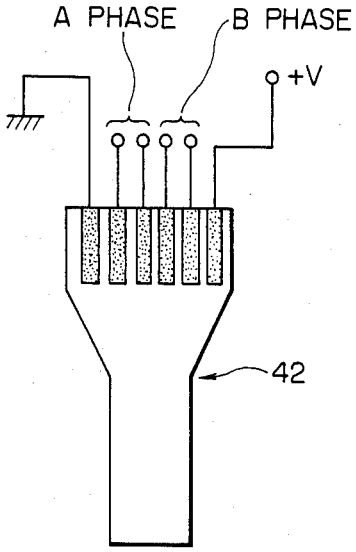
FIG. 4 is a side view showing a linear sensor of the printer in FIG. 2.

The illustrated linear sensor 42 is a magnetic sensor which is so disposed that there is a clearance t (FIG. 2) between the linear scale 41 and the linear sensor 42. Clearance t is of the order of 100 μm. During printing as head carriage 26 reciprocates, the linear scale 41 is displaced relative to a predetermined reference point. The linear sensor 42 detects the displacement and generates two outputs: an "A" phase output and a "B" phase output as shown in FIG. 4.

Figure 5A:
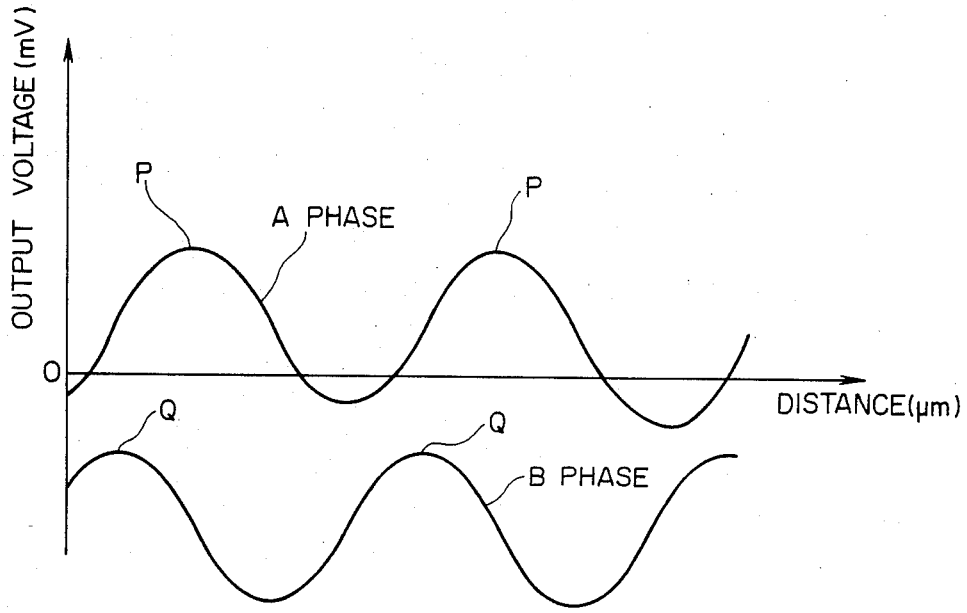
FIGS. 5A and 5B is a graphical representation indicating the output voltage characteristic of the linear sensor.
Figure 5B:
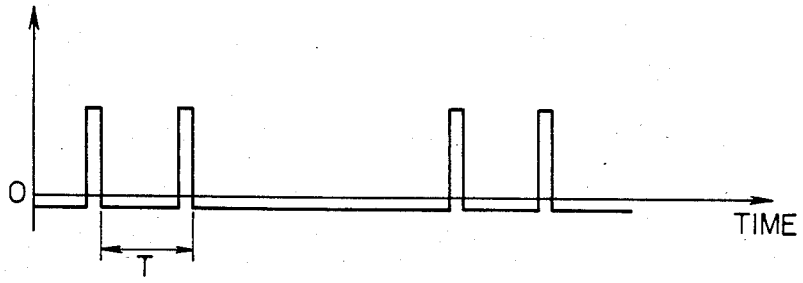

FIGS. 5(*a*) and (*b*) shows the output voltage characteristics of linear sensor 42. As shown in FIG. 5(*a*), the waveforms of the "A" phase output voltage and the "B" phase output voltage are substantially sinusoidal, and the distance between the peaks P and P, or Q and Q is constant. As shown in FIG. 5(*b*), the linear sensor 42 produces a rectangular-wave-shaped pulse voltage at each of the peaks P and Q of the "A" phase output waveform and the "B" phase output waveform. The number of the pulses is integrated by an integration circuit and processed, so that the amount of displacement of the linear scale is detected. As a result, the present position of the head carriage 26 with respect to a predetermined reference position is detected, while the printing timing of the printing heads 27 is detected, so that the printing heads 27 print characters or the like as predetermined positions on the printing sheet A. Since two phases, the "A" and "B" phases, are employed, the repetitive period T of the pulse voltage is shorter than that in the case of a single phase, and the detecting operation is also more accurate.

The actual operation of the above-described printer will now be further described.

The sheet A is fed stepwise in the direction of arrow 210 in FIG. 2 as the cylindrical platen 28 rotates in the direction of arrow 220.

When the motor 21 is rotated in the direction of arrow 230, the rotation of the motor is transmitted through the worm gear mechanism 22 to rotate work wheel 23 in the direction of arrow 240 which rotates the gear 24 counterclockwise in the direction of arrow 250. Cam shaft 29, embedded in gear 24, thereby rotates counterclockwise while in slidable engagement with cam groove 31 in cam plate 30 which is mounted on head carriage 26. As the cam shaft 29 rotates with gear 24, the cam shaft 29 in cam groove 31 causes cam plate 30, attached to head carriage 26, to reciprocate as shown by arrow 260. Accordingly, the head carriage 26 is reciprocated with a predetermined stroke along the guide shaft 25, in the printing line direction perpendicular to the sheet feeding direction, by the camming action of the cam plate 30 and the cam shaft 29, while the printing heads 27 print on the sheet A. In this operation, the linear sensor 42 detects the displacement of the linear scale 41 on the head carriage 41 from the reference position to produce a detection signal. The detection signal is processed as described above in connection with FIGS. 5(*a*) and 5(*b*), so that the position of the head carriage 26 is detected while the printing timing of the printing heads 27 is detected, whereby the printing heads are thus controllably allowed to print in place on the sheet A.

As is apparent from the above description, in the printer of the invention, the position of the head carriage 26 and the printing timing of the printing heads can be detected directly from the head carriage. Accordingly, the printer of the invention, unlike the conventional printer using the rotary encoder, can print with current printing time at all times being not affected by the configuration, wear and mounting accuracy of the cam in the head carriage driving mechanism.

What is claimed is:

1. A dot line printer comprising:

a head carriage;

a plurality of printing heads mounted on said carriage at equal separations;

a platen mounted in confronting relationship with said heads and adapted for receiving and advancing a sheet to be printed in a given direction;

a linear scale mounted on said head carriage for movement therewith, said linear scale including a plurality of magnets positioned side by side such that the north pole of each magnet is adjacent to the south pole of another magnet; and a linear sensor mounted stationary with respect to said linear sacale and at a predetermined clearance therefrom for detecting linear displacement of said scale to provide printing timing for said heads.

2. A dot line printer according to claim 1 including a frame and wherein said reciprocating means includes:

a groove cam plate mounted on said carriage;

a cam means mounted on said frame for engaging said cam plate; and a motor and gear means for driving said cam means to produce reciprocation of said carriage.

3. A dot line printer according to claim 2 wherein said cam means includes a gear and a cam shaft embedded in said gear at a predetermined distance from the center thereof, said cam shaft slidably engaging said groove in said cam plate.

4. A dot line printer according to claim 1 wherein said linear sensor is a magnetic sensor.

* * * * *